United States Patent [19]

Stucky

[11] 3,999,355

[45] Dec. 28, 1976

[54] METHOD OF CONSTRUCTING A TRANSPORTABLE PREFABRICATED ROOM ELEMENT

[75] Inventor: Fritz Christoph Stucky, Baar, Switzerland

[73] Assignee: Credelca AG, Zug, Switzerland

[22] Filed: Jan. 22, 1975

[21] Appl. No.: 543,184

[30] Foreign Application Priority Data

Jan. 31, 1974 United Kingdom ..... 4512/74
July 26, 1974 United Kingdom ..... 33022/74

[52] U.S. Cl. ..... 52/745; 52/79.13; 52/227; 52/236.6; 29/469

[51] Int. Cl.[2] ..... E04B 1/35; E04H 1/04

[58] Field of Search ..... 52/79, 236, 745, 747, 52/227, 241

[56] References Cited

UNITED STATES PATENTS

| | | | |
|---|---|---|---|
| 3,460,308 | 8/1969 | Stucky et al. | 52/745 |
| 3,503,170 | 3/1970 | Shelley | 52/79 |
| 3,540,173 | 11/1970 | Johnides | 52/79 |
| 3,568,380 | 3/1971 | Stucky | 52/79 |
| 3,616,592 | 11/1971 | Rothman | 52/745 |
| 3,834,110 | 9/1974 | Vercelletto | 52/79 X |

FOREIGN PATENTS OR APPLICATIONS

| | | | |
|---|---|---|---|
| 1,259.041 | 3/1961 | France | 52/745 |
| 1,269,080 | 7/1961 | France | 52/79 |

*Primary Examiner*—Price C. Faw, Jr.
*Assistant Examiner*—Leslie Braun
*Attorney, Agent, or Firm*—Brumbaugh, Graves, Donohue & Raymond

[57] ABSTRACT

In the embodiment of the invention described herein and shown in the accompanying drawings, a transportable prefabricated room element has a rigid frame or chassis which comprises a rigid base structure or floor panel structure and a vertical load-bearing structure permanently and rigidly fixed to the floor panel structure at an intermediate region in the length of the latter. This frame or chassis is preferably of inverted T formation in side elevation. At each side of the vertical structure, there is a prefabricated three-dimensional cell unit, each of which units consitutes a three-dimensional region of the room element and has a vertical wall and a roof or ceiling and/or a floor and is assembled to or with the frame or chassis in substantially-finished condition. At each end the floor panel structure freely supports at least one vertical load-bearing strut for carrying vertical loads imposed by a superimposed room element. These struts are at least partly enclosed in end walls of the extreme cell units. The extreme end walls of the cell units substantially coincide with or slightly overlap the ends of the floor panel structure. In a plural story building, the room elements are stacked on one another with their vertical load-bearing structures in register, and these registering vertical structures are post-tensioned together by post-tensioning means extending down through them:—possibly into a foundation of the building.

6 Claims, 14 Drawing Figures

METHOD OF CONSTRUCTING A TRANSPORTABLE PREFABRICATED ROOM ELEMENT

This invention relates to buildings and specifically to transportable prefabricated room elements for erection into a single storey or plural storey building (e.g. a dwelling). More specifically, the invention is concerned with the room elements having a length of 11.20m or more. The dimensions of the room elements desirably conform to the standard for transportable containers which at present is 40ft (12.18m) in length and 8ft (2.43m) in width. The height is not critical but may be 8ft or more, that is to say, the height conforms to that of a storey.

The expression "transportable prefabricated room element" is employed herein to define a transportable prefabricated cell-like structure having two opposed sides and two opposed ends constituting four faces of the cell, and comprising a base structure or floor panel structure and a vertical load bearing structure rigidly connected to the base or floor panel structure for supporting parts of the building (such for example, as a roof or ceiling or the floor panel structure of a superimposed room element) extending over and positioned above the floor panel structure, which element is adapted to be mounted face-to-face with a further such element in building up a storey, or part of a storey, of a building from a plurality of such elements. The expression "face-to-face" includes side-by-side, end-to-end, and end-to-side. The expression "vertical load-bearing structure" includes a vertical load-bearing wall and spaced vertical load-bearing columns. The said columns may support fill-in panelling to close, or partly close, a region of the load-bearing structure, and the expression "fill-in panelling" includes a wall panel, a door, or a window, and in the case of a wall panel the latter may be integral with the two columns between which it extends or may be attached to them. Such room elements and buildings incorporating them form the subject of British Patent Specification Nos. 1,101,597; 1,101,385; 1,068,172; 1,027,241; 1,027,242; 1,034,101; 1,250,883 and 1,271,024 to which reference may be made for further particulars.

It has been proposed to fabricate such room elements on the basis of a load-bearing frame or chassis which consists of initially separate components, viz. a reinforced floor panel structure and reinforced vertical load-bearing end structures, the latter being rigidly connected to opposite ends of the panel.

Such room elements are intended to be fabricated in a substantially complete manner at a factory remote from the building site. In particular such electrical wiring, plumbing and heating installations, doors, partitions, glazing and interior finish, as are required in the complete building are applied to the room elements at the factory so as to bring them to a substantially finished condition. The room elements are then transported to the building site and there assembled into a building to which only the minimum finishing work such for example as concealing joint lines needs to be carried out.

The ceiling or roof, some or all of the side walls and any interior partition walls of such room elements have hitherto been fabricated in the room-elements while they are travelling along a production line by means of conventional building methods. Such methods are not compatible with modern factory production techniques and this, with the limited access for workmen which renders it difficult for more than one team to work at a time, has meant that progress along the production line has been slow and the advantages of fully industrialised production have not been realized.

One object of the present invention is the provision, in a transportable prefabricated room element, of a particularly simple and advantageous construction of rigid frame or chassis — in particular, of a construction which lends itself especially well to the completion of the finished room element by the use of pre-fabricated three-dimensional cell units as hereinafter explained and to a simpler mode of assembly, and which permits such cell units to be used in such a manner that they may determine the overall dimensions of the finished room-element, thus making the manufacturing tolerances of the room-element independent of those of the frame or chassis.

This invention therefore provides a transportable pre-fabricated room element as hereinbefore defined having a rigid load-bearing frame or chassis, characterised in that this frame or chassis is substantially of inverted T formation in side elevation and comprises a rigid base structure or floor panel structure and a vertical load-bearing structure permanently and rigidly fixed to the base or floor panel structure at an intermediate region in the length of the latter.

It may be here explained that the factory production of transportable prefabricated room elements has hitherto necessitated the room element under construction being moved along a single production line along which various workmen or teams of workmen operate at spaced stations to carry out successive and different manufacturing and finishing operations on the room element. Thus the time taken to complete a finished room element is governed by that taken for the slowest and most elaborate work item.

It is further object of the present invention to speed up the production time of factory-made room elements by the use of pre-fabricated cell units, the manufacture of which is divorced from the main assembly line and which may be brought, in substantially-finished condition, to that main line and assembled on or to the rigid load-bearing frame or chassis.

Therefore, according to a feature of the present invention the room element (having the aforesaid inverted T frame or chassis) has at least one pre-fabricated three-dimensional cell unit mounted at each side of the load-bearing structure, each of which cell units comprises at least a vertical wall and a roof or ceiling and/or a floor.

That is to say, these cell units constitute pre-fabricated spatial units which form three-dimensional regions of the room-element and may include (and are desirably pre-fabricated complete with) all or substantially all the installations appropriate to said regions of the complete room elements. The expressions "installations" includes any or all of the following: — pipes and conduits for services and plumbing (such as water, electricity, and gas); the required fixtures and fittings such as electric junction boxes, electric switches, and lighting and heating wiring, or channels or recesses for the reception of such pipes or conduits and/or the required fixtures and fittings; passages for post-tensioning cables or other structural means; glazing doors; such decorative or protective surfacing materials or surface finishes (interior and/or exterior) as may be required;

partition walls, closets; stairs; cabinet work; utilities such as heating fixtures, kitchen equipment, bath fixtures, toilet fixtures, laundry equipment; built-in-furniture; acoustic and/or thermal insulation.

This invention also provides a transportable prefabricated room element as hereinbefore defined, having a rigid load-bearing frame or chassis comprising a rigid structure or floor panel structure and a vertical load-bearing structure rigidly and permanently fixed to the base or floor panel structure at an intermediate region in the length of the latter, and having at least one prefabricated three-dimensional cell unit mounted at each side of the load-bearing structure, each of which cell units comprises a vertical wall and a roof or ceiling and/or a floor.

The use of pre-fabricated cell units gives great flexibility in the design of the room-elements in that a given frame or chassis may be fitted with different cell units to form different room-elements, and in that such cell units may be fitted to different frames or chassis having the same overall dimensions. Typical cell units are a bathroom unit, staircase or stairway unit, heating unit, elevator shaft unit, cloakroom unit, toilet unit, a unit forming all or part of a living or dining space, or any other space region of a room element capable of being prefabricated as a cell unit. Where the cell unit is a "wet" cell unit or comprises a wet region (e.g. is a bathroom or cloakroom cell unit or a unit comprising a bathroom or cloakroom region) then the wet cell unit or wet region may comprise a floor portion which rests on the floor panel structure and is adapted to prevent migration of water from the wet cell unit or wet region to adjacent cell units or adjacent regions.

Some or all of such cell units may be pre-fabricated at the factory, or obtained from an outside source (e.g. in finished condition, or in a condition requiring finishing at the factory prior to assembly to the frame or chassis). Some cell units may also be sent to an outside facility to have certain portions of specialised work completed prior to assembly to the frame or chassis in the factory.

An advantage of the inverted T shape of the frame or chassis is that the cell units can be introduced from the ends. It is more convenient to provide the room element with its end structure and external skin as integral parts of the cell units than to provide them separately. Slender struts can be inserted in a mould for a cell unit so that they are cast into the latter, or they can be inserted in channels in a cell unit and secured by an adhesive such as epoxy resin. This is easier than installing the struts in place in the room element under construction, and automatically provide them with fire-protective casing. Weather-resistant surface finishes may be moulded directly onto the cell units on those faces exposed to the exterior. This is easier than attaching a supplementary panel to the room element or providing the room element with a weather proof surface. Windows and doors complete with sills and flashing can be cast in, thus eliminating the need for caulking and cover strips as well as eliminating some installation and tolerance problems. Finally, the cell units may be made to extend slightly beyond the sides and extreme ends of the frame or chassis, thus allowing the overall horizontal dimensions of the room-element to be determined by the assembled cell units (which can be readily adjusted at their assembly to the frame or chassis and whose manufacturing tolerances are relatively small) rather than by the frame or chassis (which is more difficult to adjust at its assembly from substructures and whose manufacturing tolerances are coarser).

Desirably, the width of the cell units is substantially the same as that of the frame or chassis. Thus the effective width of the room element may be determined by allowing the easily-controlled cell units to slightly overlap the frame or chassis, rather than by relying on the casting or manufacturing accuracy of the frame or chassis. The height of the cell units above the base or floor panel structure is desirably substantially the same as that of the vertical load-bearing structure.

The extreme end faces of the cell units may be substantially coincident with the ends of the floor panel structure. This construction simplifies a number of fabrication, and intallation operations in that the length of the base or floor panel structure is not necessarily critical and the cell units can be substantially finished prior to being assembled to the frame or chassis.

Desirably, the base or floor panel structure comprises at least one sub-structure at each side of, and rigidly connected, to the base of the vertical load-bearing structure. These sub-structures may be substantially of equal length or may be of differing lengths in order to permit the vertical load-bearing structure to be displaced from the center of the complete floor panel structure by as much as 1.20 m. One or each of the sub-structures may be of monolithic cast concrete construction.

Alternatively at least one or each of the sub-structures may comprise a plurality of (e.g. two) longitudinal beams the space between which may, if desired, be occupied by flooring, or may provide for communication between successive storeys of a plural-storey building. In order to provide such flooring one or more of the cell units may comprise a floor slab supported by and spanning between said longitudinal beams or between the vertical walls of the cell or both.

The sub-structures are connected to the base of the vertical load-bearing structure by a joint which is moment-resistant. Thus, the frame or chassis is adapted to take all or substantially all of the loads imposed on the room element during construction of the latter, transport to the building site, erection into the building, and in the resultant building. In particular, the moment-resistant connection adapts it to take horizontal loads, e.g. wind forces.

At each end of the base, or floor panel, structure there is at least one load-bearing vertical strut freely supported thereby. That is to say, the joints between these struts are not moment-resistant and may be what are (symbolically) termed, in engineering or constructional parlance, hinge or pin joints. The struts can thus be relieved of all bending moments and can act in pure compression, contributing little or nothing to the lateral stability of the eventual building but serving to assist in supporting a roof or ceiling or the floor panel structure of a superimposed room element. They can be at least partly enclosed in the outer portions of the extreme cell units. A strut may be provided at or near each corner, or some (e.g. three) of the corners, of the floor panel structure.

Room elements according to this invention are applicable to single-storey and plural-storey buildings. In a plural-storey building superimposed storeys incorporate the room elements with their load-bearing structures in vertical register. In very high buildings (i.e. what are termed "high rise" buildings) problems arise with wind loads and seismic loads. In such a building, lateral rigidity largely depends on the rigidity of the column formed by the registering vertical load-bearing structures against lateral loading, each such structure tending to deflect horizontally. Such deflection urges the vertical structures to deform or bend in their height and to rotate about their bases. The base or floor panel structures tend to resist such rotation via their rigid, moment-resistant connections with the bases of the vertical structures. Nevertheless, the residual rotation plus the bending that occurs produces a horizontal deflection that is cumulative from storey to storey and may reach intolerable proportions.

A further object of the invention is to overcome or minimise this difficulty.

For this purpose the registering load-bearing structures are post-tensioned together by post-tensioning means extending down through them. The post-tensioning renders the registering vertical load-bearing structures equivalent to a single rigid column or tower and materially enhances the rigidity of the building.

By essentially unifying two vertically consecutive load-bearing structures in this way, two effects are realised which reduce horizontal deflection under lateral load. Firstly, the moment-resisting connection of the column base above to the column head below produces an additional restraint against rotation of said base. Secondly, the associated continuity effect produces reverse bending in the upper part of the lower column, thus counterracting a substantial portion of the horizontal deflection.

In a building wherein the vertical load-bearing structure of a room element in the lower storey stands above a foundation or other support, the post-tensioning means desirably extends down into said support.

The invention also provides a method of constructing a transportable prefabricated room element as hereinbefore defined which comprises:

a. prefabricating a rigid load-bearing frame or chassis of inverted T formation in side elevation and substantially of storey height, comprising a base or floor panel structure and a vertical load-bearing structure rigidly fixed to the base or floor panel structure at an intermediate region in the length of the latter, by;

b. assembling at least two sub-structures of the base or floor panel structure in end-to-end relationship on opposite sides of the base of the vertical load-bearing structure and;

c. rigidly and permanently fixing adjacent ends of the sub-structures to each side of the base of the vertical structure and thereby to each other;

d. and incorporating at least one prefabricated three-dimensional cell unit on the floor panel structure at each side of the vertical structure with the extreme end faces of the cell units substantially coincident with the outer ends of the base or floor panel structure, each of which cell units comprises a vertical wall or walls, and a roof or ceiling and/or a floor.

Each cell unit may be mounted on the frame or chassis subsequent to the pre-fabrication of the latter. Alternatively at least one cell unit is mounted on a sub-section of the base, or floor panel, structure prior to the pre-fabrication of the frame or chassis. Indeed at least one cell unit may include a sub-section of the base, or floor panel, structure.

The invention further includes a method of erecting a plural-storey building, which comprises stacking a plurality of the invented pre-fabricated room elements on top of one another with their vertical load-bearing structures in register and further comprising the post-tensioning of said registering structures together in those cases where enhanced resistance to lateral forces is required.

In order that the invention may be better understood reference will now be made to the accompanying drawings, in which:

FIG. 3 is an exploded perspective view showing the frame or chassis and two cell units, while;

Figure 1:
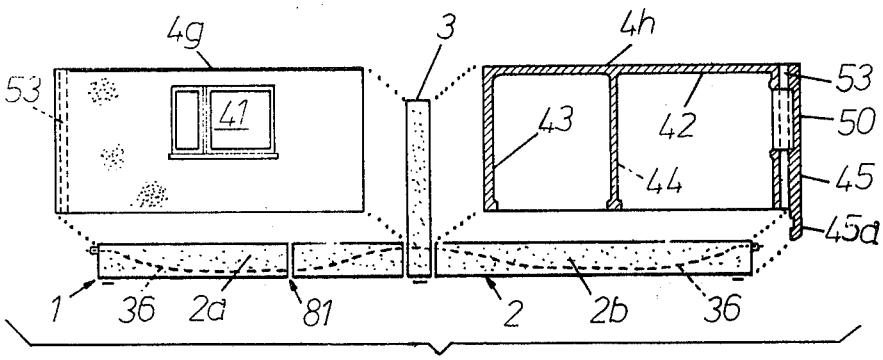
FIG. 1 illustrates the frame or chassis with two cell units about to be applied to it, unit 4*b* being shown in section.

In FIG. 1 the rigid frame or chassis is indicated generally at 1 and comprises a horizontal base or floor panel structure 2 having at an intermediate region in its length an upstanding vertical load-bearing structure 3 rigidly attached to it, so that the rigid frame or chassis is of inverted T form in side elevation. At opposite sides of the vertical structure 3, three-dimensional cell units 4*g* and 4*h* are mounted on the frame or chassis with their inner faces against the side faces of the load-bearing structure 3 and their outer end faces substantially coincident with the ends of the base or floor panel structure 2. The width of these units is substantially the same as that of the frame or chassis. Their lengths are such that when assembled to the frame or chassis, the total length of the room element is slightly greater than or substantially equal to that of the frame or chassis. Their height is substantially the same as the clear height between base or floor panel structures.

Figure 3:
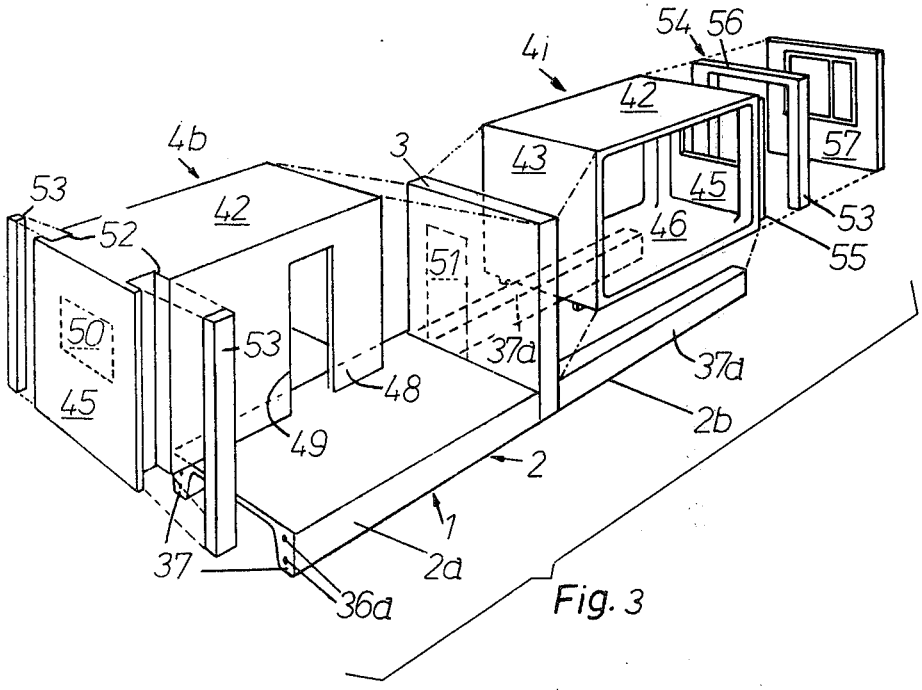
Figure 5:
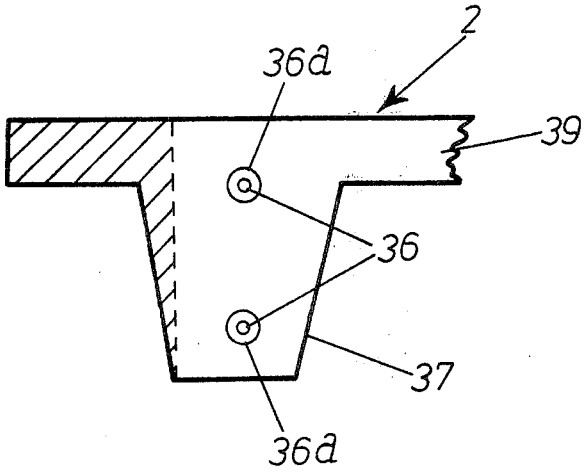
FIG. 5 shows post-tensioning means in the floor panel structure.

The two sub-sections 2*a*, 2*b* of the floor panel structure may be constructed of reinforced concrete rigidly connected to the base of the load-bearing structure 3 by post-tensioning cables 36 which extend through suitable ducts 36*a* (FIGS. 3 and 5) in the sub-structures and in the base of structure 3. These ducts desirably extend through ribs 37 at the under-side of the sub-structures. FIGS. 3 and 5 show that these ribs 37 can be cast integrally with a relatively thin floor slab but the right hand part of FIG. 3 shows that these ribs may constituted be separate longitudinal members 37*a*. The ribs may be 35cm deep and 20cm wide.

The post-tensioning cables 36 may be draped as shown in FIG. 1 or may be straight.

The sub-sections 2*a*, 2*b* may be of the same length or may differ in length by not more than about 1.20m and the overall length of the frame or chassis should be about 12m and at least 11.20m.

They may be cast in reinforced concrete in long moulds of constant section but with movable shutters, or they may continuously extruded and cut off to the desired lengths. If the ribs are not made integral with a floor slab, it may be advisable to provide a moment-resistant cross connection (e.g. a cross beam or header beam) at their outer ends. If the ribs and a floor slab are made integrally, the floor slab may have a hole or holes for stairs, utilities, and other services.

The method of fabricating the frame or chassis 1 is to arrange the sub-sections 2*a* 2*b*, in end-to-end relationship at either side of base of the structure 3, the relationship of these components being fixed by a jig or template. If strict dimensional accuracy is required, there may be employed a jig the basic principles of which may be gathered from U.S. Pat. No. 3,460,308. On the other hand, if the final dimensions of the room element are determined by the cell units so that strict dimensional accuracy of the frame or chassis is not required, a jig may not be necessary (or only a simple jig or template may suffice) but then the cell units themselves should be positioned by a jig or template. While the components of the frame or chassis are being held in the correct relationship, the cables 36 are passed through the appropriate conduits 36*a* and placed under tension and their ends anchored in or to the ends of the sub-structures.

The base of vertical structure 3 may have a protruding foot at one (or each) side (being, therefore, of L-shape or inverted T-shape) against the end face of which a sub-section is disposed, so that this foot (or these feet) in effect form part of the structure 2. This has the advantage of making the structural connection at a location where the bending stresses are appreciably reduced.

The base, or floor panel, structure 2 may comprise a plurality of sub-sections fixed in end-to-end relationship at least at one side of the vertical structure 3, as indicated in dotted line at 81.

Gaps may be left initially between the ends of the sub-sections and the adjacent faces of the vertical structures 3, and filled with a quick-setting filler such as cement mortar, plastic resin such as epoxy or polyester resin, or molten metal. The size of the gaps may be adjusted to produce the desired overall and intermediate longitudinal dimensions of the frame. Alternatively, the gaps may be made of minimal width or to some optimum or arbitrarily constant width and the manufacturing tolerances of the components compensated elsewhere as will be described later. As a further alternative, the three components may be butted together in direct contact without mortar.

If there is a mortar-filled gap at one or both sides of the vertical structure 3 the members 36 are not tensioned and anchored until the mortar has set. They may each be tensioned to 7 or 8 tonnes or more.

A suitable mortar or cement is disclosed in U.S. Pat. No. 3,762,122.

If some or all of the components are made of metal (primarily steel) these may be fixed together by bolting, riveting or welding technique.

Figure 2:
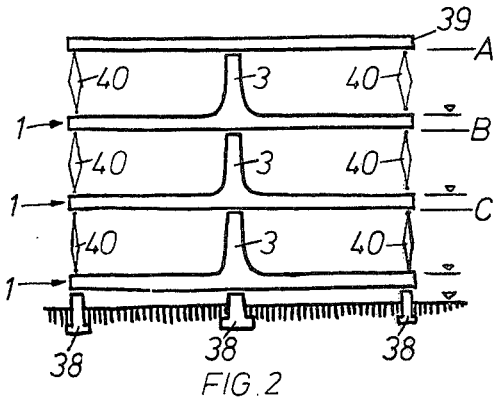
FIG. 2 is a schematic diagram illustrating the stacking of the frames or chassis of successive room elements on one another in a plural storey building.

FIG. 2 illustrates how successive room elements are stacked on one another with the frame or chassis 1 of each lower room element supporting the frame or chassis of the next superimposed room element, the load-bearing structures 3 being in vertical register. The lower frame or chassis rests on foundations 38 and the upper one supports a roof 39. This roof may be a panel resembling a floor panel structure and may be formed in one piece or may be fabricated from a plurality of components. End struts 40 are shown at the two ends of the frame or chassis, their main function being to provide vertical support and stabilisation of the construction and not to resist any moments (particularly, not those due to wind). It is for this reason that they are shown diagrammatically as being pivotally connected to the floor panel structures.

Figure 7:
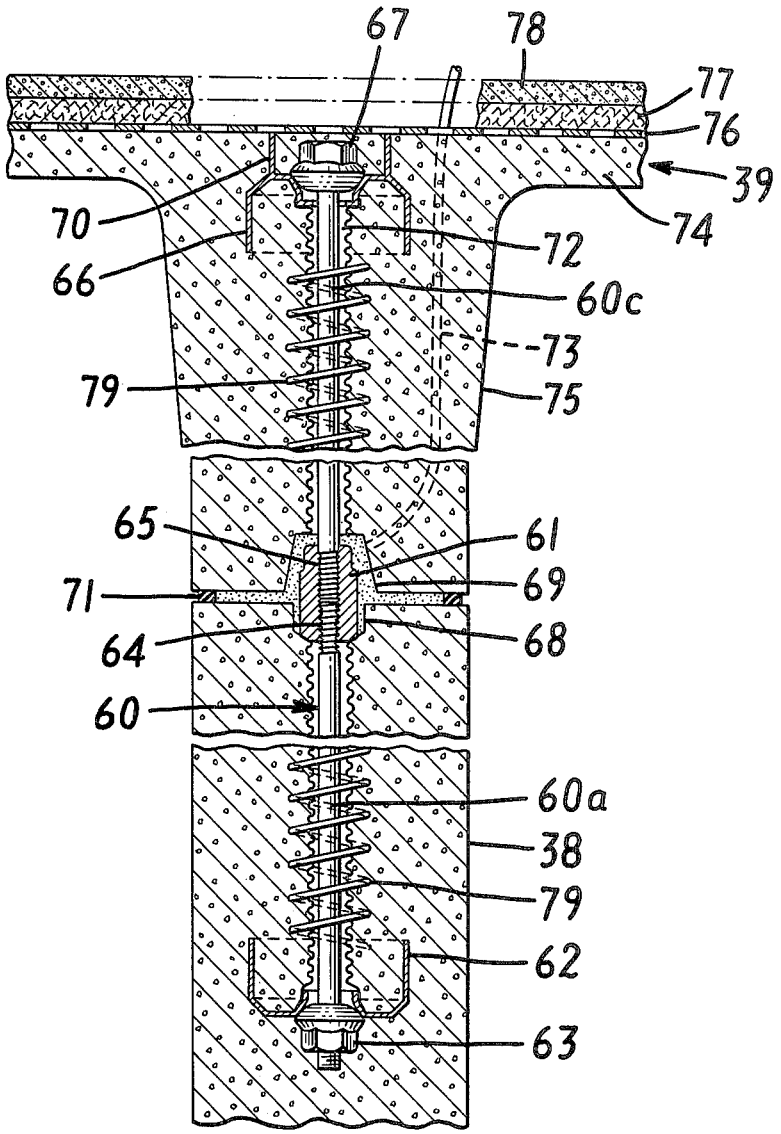
FIG. 7 is a sectional view showing part of the post-tensioning means—

Bearing pads of a resilient character (e.g. neoprene) are desirably provided at all vertical support points in the planes, A, B, C, see 71 FIG. 7. Alternatively, or in addition, vertical rods protruding from the top of the vertical load-bearing structure 3 of one frame or chassis may be received in clearance holes in the underside of the superimposed frame or chassis with the clearance occupied by a setting mortar. If the vertical structures are post-tensioned together, the bearing pads take the form of rings which serve to maintain the proper spacing of bearing surfaces and to confine the subsequently injected mortar grout.

FIG. 1 shows that the cell unit 4*g* may be provided in a side wall with a window 41 while FIG. 3 shows an open sided cell unit 4*i*. FIG. 1 also shows a cell unit 4*h* having a ceiling 42 and vertical transverse walls 43, 44 and 45 depending therefrom. This unit is shown as being void of a floor whereas unit 4*i* has a ceiling 42, end walls 43 and 45, and a floor 46. FIG. 3 also shows the unit 4*b* as having a ceiling 42, at least one end wall 45, and a side wall 48 which may provided with a door 49. Wall 45 may have a window 50.

FIG. 3 shows the intermediate vertical load-bearing structure 3 as a solid panel. In such a construction, and also if this structure consists of two vertical columns with filled-in panelling joining them, it may be provided with a door 51.

The exterior walls of the cell units are non-load bearing walls.

Wall 45 is shown as having channels 52 at the exterior face of the cell, which accommodate end struts 53 which carry the facade loads and that portion of the floor load (e.g. 20%) which is not carried by the intermediate structure 3 but which struts contribute nothing to the rigidity, in the longitudinal direction, of the room element. They stand on the floor panel structure and constitute the struts 40 of FIG. 2. Wall 45 has a downwardly protruding lower margin 45*a* which overlaps the adjacent end of the floor panel structure. FIG. 1 shows similar struts 53 in the end wall of cell unit 4*g*. Struts 53 may be of reinforced concrete or steel and are of room height. The struts are at least partly encased in the ends of the cells.

The end wall of cell 4*g* may have an overlapping lower margin similar to 45*a*.

Figure 4:
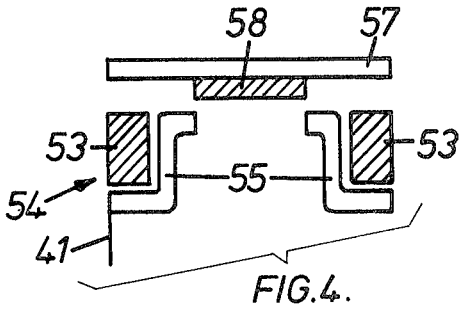
FIG. 4 is a sectional plan view at the right hand end of the assembly shown in FIG. 3.

In FIGS. 3 and 4 the struts 53 at the outer end of cell unit 4*i* are shown as being parts of a U-shaped portal frame 54 into which the end portion 55 of that unit is received. These struts are connected at the top of the portal frame by a cross-member or lintel 56. They may also be connected at the bottom by another cross-member or spandrel so that the frame is of open rectangular form. The frame 54 is preferably of monolithic reinforced concrete construction but it may be fabricated from steel profiles or from pre-cast concrete components.

The outer end face of the frame 54 may be closed by a facing panel or curtain wall 57, provided, for example, with a window 58. The lower margin of this panel 57 may overlap the adjacent end of the floor panel structure. A similar panel may be provided for unit 4*g*.

The provision of a lower marginal part of the end wall (see 45*a*) or of a facing panel (see 57) of at least one of the extreme cell units permits the overall length dimension of the room element to be independent of the length of the floor panel structure 2.

The cell units may be set on the floor panel structure in a bed of cement or epoxy or they may rest on bearing pads of synthetic rubber (e.g. neoprene). If the frame or chassis 1 is not fabricated to very close tolerances the cell units may be adjusted relatively to it and to each other to obtain the desired overall dimensions. It is for this reason that the lower portion 45*a* of the wall 45, and of curtain wall 57, is shown as overlapping the end of the base structure 2. More than one cell unit may be positioned at one or each side of the load-bearing structure 3. These cell units may be permanently coupled together before being added to the frame or chassis or they may be added individually.

The exterior skin of those cell units which have their walls exposed may be of weather-resistant material such as concrete, for example exposed aggregate concrete, or other suitable building material (steel, aluminium, cement-asbestos) or may be made weather resistant by applying a surface finish in the mould or subsequent to de-moulding which is itself impervious to weather, for instance glass or ceramic tesserae, stucco or paint. Alternatively, a separate weather-resistant skin may be provided in the form of a curtain wall panel (see 57 as an example). This panel may be cast integrally with the cell unit, in the same or a different material leaving spaces for the struts 53 and including rigid foam insulation or it may be cast separately and attached to the cell unit before or after the introduction of the latter to the frame or chassis thus sandwiching the struts 53 and the thermal insulation. Windows or frames may be cast into a vertical wall of the cell unit or may be attached later.

Each cell unit is substantially finished prior to or after its addition to the frame or chassis by providing it with such interior finish installations, utilities, and exterior wall finish as may be necessary in the corresponding region of the room element.

The interior finish includes partition walls, ceiling (floor panel in the event no floor slab is provided in the basic structural unit), doors, closets, stairs, cabinet work, surface finish, trim, acoustic insulation, installations, utilities etc.

Installations include heating, lighting fixtures, bath fixtures, toilet fixtures, kitchen equipment, laundry equipment, built-in-furniture, etc.

Utilities include wiring, plumbing, heating and ductwork.

Exterior wall finish includes thermal insulation, vapor barrier, weatherproofing, surface finish, trim, windows and blinds, gasketing and caulking, roofing and flashing, doors, sunshades, etc.

Figure 6:
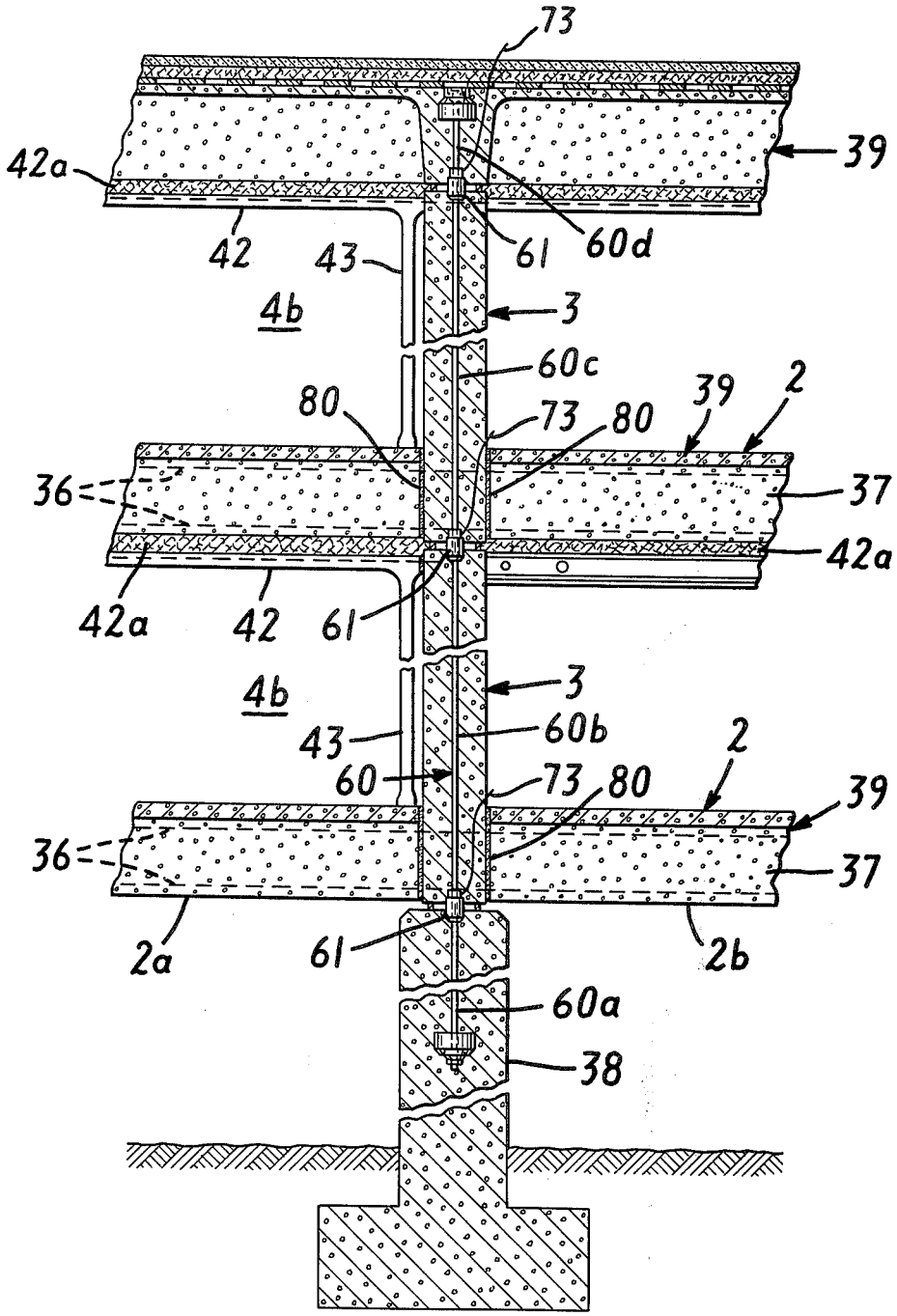
FIG. 6 is a section view showing how the frames or chassis of superimposed room elements are mounted one on another and on a foundation, and are post-tensioned together and to the foundation.

Turning now to FIGS. 6 and 7, these show how in a plural-storey building, the frames or chassis of superimposed room elements may be superimposed on one another and their vertical load-bearing structures 3 post-tensioned together.

FIG. 6 shows that at least at one side of each vertical load-bearing structure 3 there may be a prefabricated three-dimensional cell unit exemplified as unit 4*b*. This cell unit has a roof 42 and at least one vertical wall 43 and stands on the floor panel structure 2. The roof 42 forms part of the ceiling of the room element. Heat and/or sound insulating material 42*a* may be provided above the roof of the cell unit. The struts 40 may be wholly or partly encased in end walls of the cell units.

FIGS. 6 and 7 also show the post-tensioning means (indicated at 60), whereby the registering intermediate structures 3 are post-tensioned together and to the foundation 38. Although this post-tensioning means 60 may be at least one continuous rod or cable, it preferably consists of a succession of lengths which, during erection of the building, are joined together end-to-end and are tensioned. This is the construction illustrated in FIGS. 6 and 7. Each such means 60 may extend through conduits in the various parts formed by plastic or corrugated steel tubes positioned in the casting mould, or by the post-tensioning means themselves by means of greased wrappings. The rods may be corrugated or ribbed (e.g. spiral or herringbone ribs) for improved bonding properties with the grouting hereinafter mentioned and the tubes may also have internal and/or external corrugations or ribs. Anchorage reinforcement spirals are indicated at 79 in FIG. 7.

In FIGS. 6 and 7 successive lengths of the post-tensioning rods are indicated at 60*a*, 60*b*, and 60*c*, and these are connected together in situ by threaded sleeves 61.

The lowermost rod length 60*a* is anchored in the foundation 3*b* by means of an anchor cup 62 and nut 63 both of which are cast in situ. The upper end has a coarse screw thread portion 64 while the lower end of the next rod 60*b* has a comparatively fine screw thread portion 65 so that when the sleeve 61 is rotated the threads of the portions 64, 65, fix the two lengths together. This arrangement is repeated at the adjacent ends of successive rod lengths.

After completion the room-elements are transported to the building site. Coupling sleeves 61 are threaded over the foundation anchor rods 60*a* and snugged firmly down. The first layer of room-elements for at least part of the building are then set in place by crane. The coupling sleeves 61 on the foundation 33 interfere with the lower ends of the rods 60*b* and displace them upward in their conduits. Alternatively, the rods may be provided with longer threads than necessary at their upper ends and installed at a higher position than in the finished building by threading the coupling sleeves 61 further on than necessary. In either event, the lower end of the rod 60*b* must now be brought into engagement with the coupling sleeve 61 at the foundation level, aided by the chamfer on the sleeve. It is then threaded in until the upper coupling sleeve is in its normal position and firmly seated in its conical recess. It may then be further tightened in order to effect a mild pressure action.

Further storeys are erected in like manner. The purpose of the differential thread is not for any supposed multiplication of mechanical advantage but merely to ensure that the post-tensioning operation proceeds as intended. The fine thread 65 with its machine-cut surface offers less screwing resistance than the quite steep rolled thread 64, thus guaranteeing that when screwing an upper rod in the coupling sleeve 61 of a lower rod, the sleeve will not turn relative to the lower rod. The upper thread will proceed to engage until the lower sleeve lifts from its conical seat. Thereafter, if tightening is continued (which it should not be) the same thread may continue to engage or another fine thread further down may begin to engage further. No coupling will be urged to turn while on its seat. Preferably each level is tightened to the point where the coupling below is just about to lift off its seat. This ensures uniform assembly and uniform extension at final stressing when the roof is on. No harm is done if a coupling lifts or turns to a slight extent, but it is convenient to maintain a certain degree of uniformity.

After the last storey is in place and stressed, the roof panel 30 is set in like manner. Its short rod 60*c* extends through the recess 70 and above the roof level. Clear of the anchor nut 67, a hydraulic jack with special jaws engages the profile of the rod (or collet jaws grip a smooth rod) and pressure is applied to stretch the whole interconnected series of rods. The degree of post-tensioning to be realised must be determined by the engineer for each individual case or at best for a series of typical cases. This will depend on building height and extent, loading and wind conditions etc.

During assembly seating rings 71 are introduced between successive components. These rings are desirably of Neoprene.

If the building is a temporary one intended for removal, alteration or other major changes not possible with conventional buildings then no more should be done as far as the post-tensioning feature is concerned. If the conduits were not formed by tubing but by greasing and wrapping the rods, there is nothing that can be done. Otherwise, the space in the recesses 69, between the Neoprene rings 71, and within the conduit 72 should be pressure injected with liquid mortar through ducts 73. This effects bonding and protects against corrosion. Preferably one starts at the bottom and works to the top, air being vented through special holes in the coupling sleeves. Finally, the excess rod at roof level may be burned off, the recess 70 filled with mortar grout and the roofing completed.

The roof panel 39 comprises a reinforced concrete panel 74 with a cross-member or rib 75 vertically in line with the intermediate wall structures 3. Above this panel there is added a roofing membrane 76, insulation material 77, and gravel or the like 78.

FIG. 6 shows how two sub-sections 2*a*, 2*b* of each floor panel 2 are connected together in end-to-end relationship at opposite sides of the intermediate wall structure 3. Each sub-section 2*a*, 2*b*, comprises a reinforced concrete panel section 39 with longitudinal ribs 37. They are rigidly connected to the base of the intermediate load-bearing structure 3 by post-tensioning rods or cables 36 extending through suitable ducts 36*a* (FIG. 5) in the ribs and base of structure 3. The ducts afford an initial clearance for the rods or cables 36 and in assembly of the frame or chassis 1 (e.g. by a template or jig the basic principles of which may be gathered from U.S. Pat. No. 3,460,308 gaps are initially left between the sub-section 2*a*, 2*b* and the base of the structure 3. This clearance, and these gaps, permit the components to be adjusted to, and held to, the desired dimensional and angular accuracy of the frame or chassis. The gaps are then filled with a quick-setting filler 80 such as cement mortar, plastic resin or molten metal and after tightening, and anchoring the ends of, rods or cables 36 a setting filler is injected into the clearances. If, at one or each side of the vertical structure 3, there are two or more sub-sections 2*a* or 2*b* disposed end-to-end the rods or cables 36 extend through them all to connect them, a gap occupied by a quick-setting filler being provided between their adjacent ends.

Figure 8:
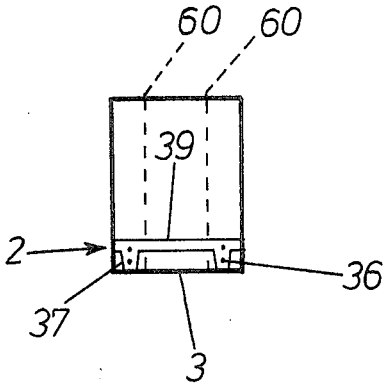
FIGS. 8, 9 and 10 are diagrams illustrating various arrangements of the post-tensioning means within the intermediate load-bearing structures.

FIGS. 5 and 8 show that, desirably, the floor panel sections have two parallel ribs 37.

Preferably, there are two-post-tensioning means 60 for each structure. In the transverse direction of the room element the post-tensioning means 60 should be symmetrically spaced so as not to interfere with the post-tensioning means 36 of the floor panel or with the moment-resistant connection of the load-bearing structure 3 and they should not be closer than 10 c.m. (axis to axis) to the post-tensioning means 36.

If the vertical load-bearing structure 3 is constituted by a solid or substantially solid wall as illustrated in FIG. 8 the post-tensioning means 60 can be spaced inwards from the horizontal post-tensioning means 37.

Figure 9:
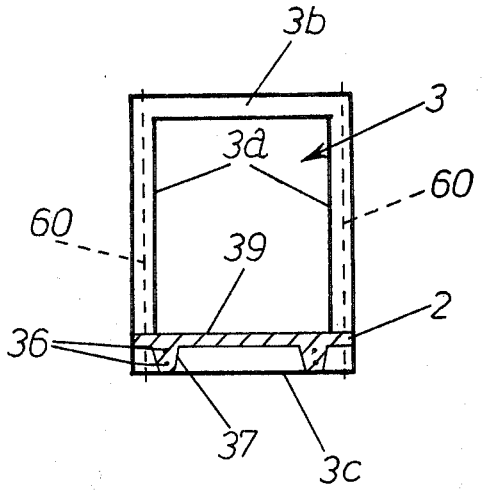

However, difficulties do occur when the vertical structure 3 comprises two spaced vertical columns 3*a* as shown in FIG. 9 particularly if the columns are disposed at the edges of the floor panel structure. It is then desirable to have the ribs 37 displaced inwards of the columns so that the post-tensioning means 60 are spaced outwards of the longitudinal post-tensioning 36. Means 60 desirably extend centrally within the columns 22 and means 36 engage a cross member of spandrel beam joining the lower ends of columns 3*a*.

FIG. 9 also shows that the columns 3*a* may be connected at the top by a cross-member 3*b* and/or at the bottom by a cross-member 3*c*, so as to form a portal frame.

Figure 10:
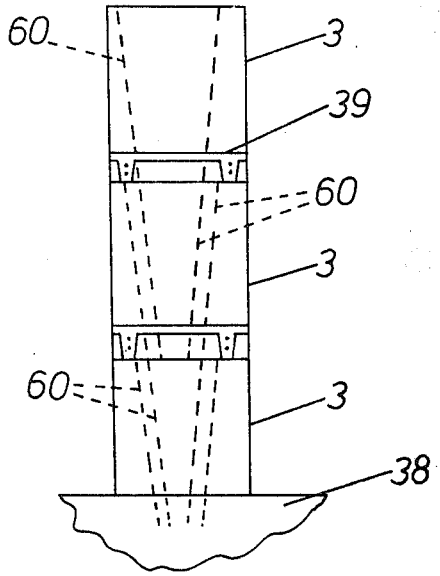

FIG. 10 shows that the post-tensioning means 60 may run diagonally so as to provide enhanced seismic resistance. The illustrated arrangement can be modified so that each of two upwardly or downwardly convergent post-tensioning means 60 extends in a single run from top to bottom of the stack of structures, provided that the inclination thereof is less than that shown in FIG. 10.

If the intermediate structure 3 of the frame or chassis is disposed mid-way in the length of the floor panel structure, the post-tensioning means 60 is desirably disposed midway in the thickness of the structure 3 (as is illustrated in FIGS. 6 and 7). However, if the structure 3 is not disposed mid-way, it may be desirable to locate the post-tensioning means 60 somewhat closer to one face of structure 3 than the other face in order to counteract non-symmetrical stress distributions introduced by the floor structure.

Figure 11:
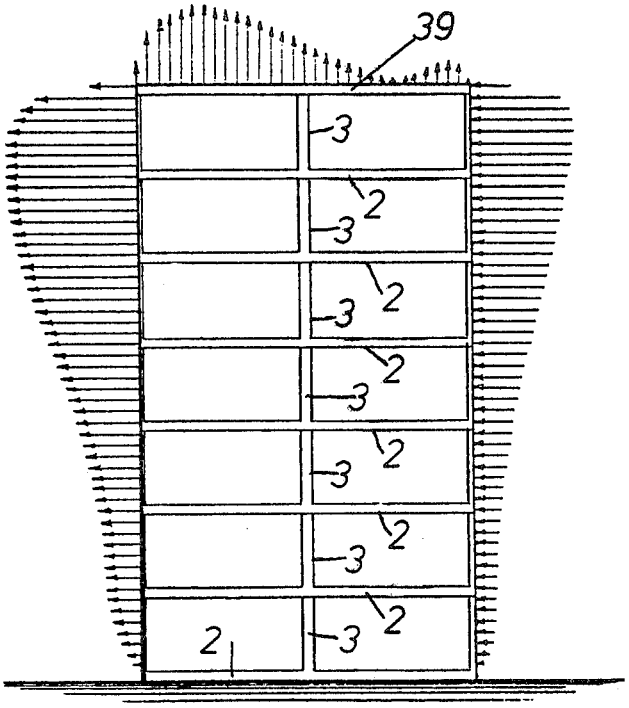
FIG. 11 illustrates the approximate distribution of wind pressure on a plural storey building.

FIG. 11 is a diagram illustrating the nature of wind pressures acting on a high-rise building. An arrow pointing toward the structure indicates positive pressure, while one directed away from it indicates negative pressure or suction. The longer the arrow, the greater the pressure intensity at the given point. In the figure, the wind is assumed to be blowing from right to left. The total force acting on a given room element is composed of the pressure on its upwind side and the suction on its downwind or lee side.

Figure 12:
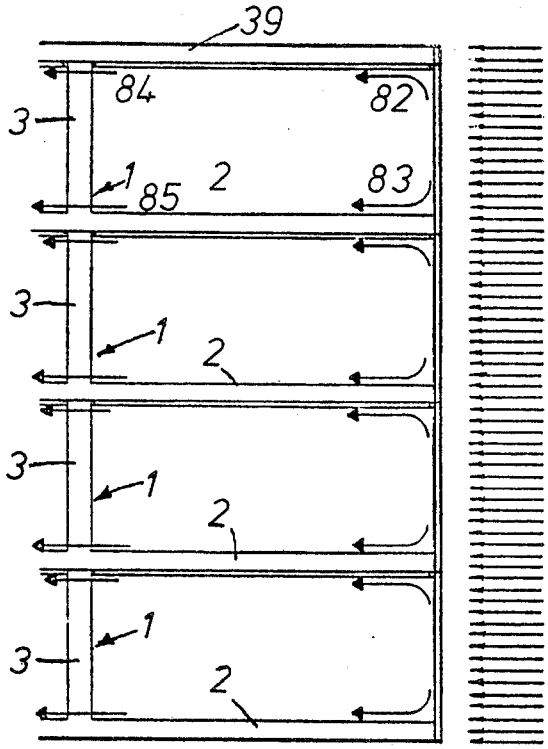
FIG. 12 illustrates the wind effect on a building.

FIG. 12 shows the transmission of horizontal forces on the windward side of part of a building made according to the invention. The wind pressure is taken up by the outer wall of each room-element and transmitted in two approximately equal forces 82 and 83 to the ceiling member 42 and the base or floor panel structure 2 respectively. These members in turn introduce the forces into the vertical load-bearing structure, which is the only member designed to resist them. The ceiling structure 42 of cell unit 4*b* imposes lateral load 84 on the head of the vertical structure 3 of its room-element, and base or floor panel structure 2 imposes lateral load 85 on the head of the vertical structure 3 of the room-element below. Force 85 is transmitted in friction or horizontal shear across the bearing pad 71. Therefore the head of each vertical structure is subjected to four lateral forces; a direct push 84*a* from the upper half of the exterior wall to windward; a direct pull 84*b* from the upper half of the exterior wall to leeward; a friction force 85 due to wind pressure and wind suction tending to urge the above element to leeward; and an augument to, or a multiple of, the same friction force corresponding to the cumulative friction forces transmitted from all further room elements above. In addition the tendency of each vertical structure 3 to rotate about its base (counterclockwise in FIG. 12) introduces a moment in the head of the vertical structure 3 below, particularly if the vertical structures are post-tensioned together.

Figure 13:
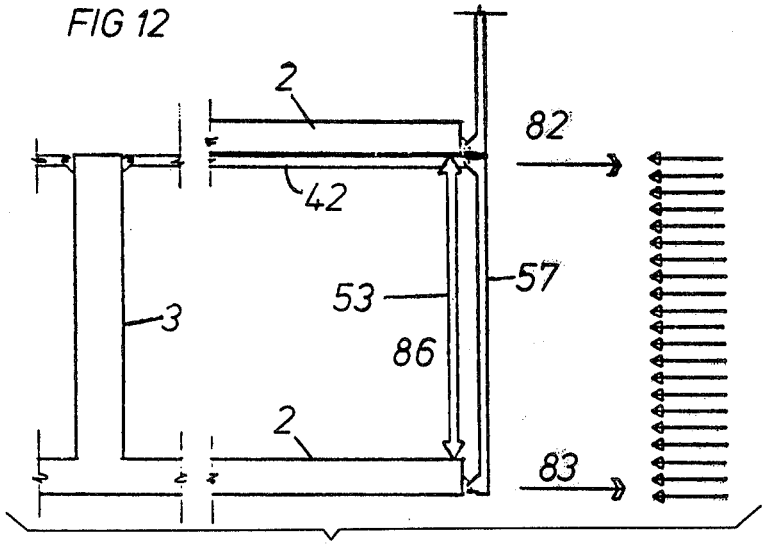
FIG. 13 is a diagram illustrating how the wind forces of pressure or suction are transferred to the frames or chassis.

FIG. 13 schematically illustrates the transmission of forces in a single room-element in more detail. Outer wall 57 is schematically illustrated as being pin-connected to base or floor panel structure 2 and to ceiling structure 42. This is to emphasize that said connections are not relied on to transmit moments and is not intended to suggest the actual construction which may comprise known means. Vertical arrow 53 symbolizes the function of struts 40 in providing a pure vertical supporting force 86 for the outer end of the room element above.

Figure 14:
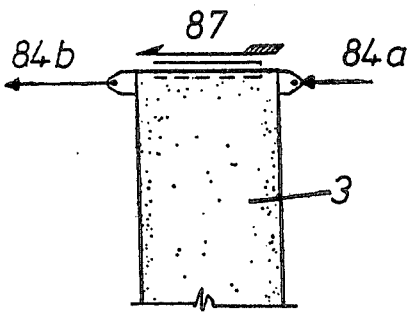
FIG. 14 is a diagram illustrating the load transfer to the frame or chassis.

FIG. 14 more clearly depicts the forces acting at the head of vertical structure 3, where arrow 84*a* represents the push from windward, arrow 84*b* the pull from leeward and arrow 87 all friction forces transmitted from above.

What is claimed is:

1. A method of constructing a transportable prefabricated room element, which method comprises:

a. prefabricating a rigid load-bearing frame substantially of storey height, comprising a floor panel structure and a vertical load-bearing structure having a base rigidly fixed to the floor panel structure at an intermediate region in the length of the latter, by b. assembling at least two sub-structures of the floor panel structure in end-to-end relationship on opposite sides of the base of the vertical load-bearing structure and c. rigidly and permanently fixing adjacent ends of the sub-structures to each other and to the base of the vertical structure;

d. incorporating at least one prefabricated three-dimensional cell unit having an end face on the floor panel structure at each side of the vertical structure with the extreme end faces of the cell units substantially co-incident with the ends of the floor panel structure at a location remote from a building site, each of which cell units comprises vertical walls and at least one of a ceiling and a floor, to form a transportable prefabricated room element;

e. and transporting the room element to a building site for incorporation into a building.

2. A method according to claim 1, wherein the frame is of inverted T formation in side elevation.

3. A method according to claim 1, wherein each cell unit is mounted on the frame subsequent to the prefabrication of the latter.

4. A method according to claim 1, wherein at least one cell unit is mounted on a sub-section of the floor panel structure prior to the prefabrication of the frame.

5. A method according to claim 1, wherein at least one cell unit includes a sub-section of the floor panel structure.

6. A method of erecting a plural-storey building which comprises:

prefabricating a plurality of transportable room elements at a location remote from a building site, each room element being constructed by prefabricating a rigid load-bearing frame substantially of storey height comprising a floor panel structure and a vertical load-bearing structure having a base rigidly fixed to the floor panel structure at an intermediate region in the length of the latter by assembling at least two sub-structures of the floor panel structure in end-to-end relationship on opposite sides of the base of the vertical load-bearing structure and rigidly and permanently fixing adjacent ends of the sub-structures to each other and to the base of the vertical structure, incorporating at least one prefabricated three dimensional cell unit on the floor panel structure at each side of the vertical load-bearing structure, each of which cell units includes a vertical wall and at least one of a ceiling and a floor, transporting the plurality of room elements to a building site, stacking the plurality of room elements on top of one another with their vertical load-bearing structures in vertical register, and post-tensioning said registering structures together.

* * * * *